US007278866B1

(12) United States Patent
Van der Steen

(10) Patent No.: US 7,278,866 B1
(45) Date of Patent: Oct. 9, 2007

(54) ELECTRICAL CARD CONNECTOR

(75) Inventor: Hendrikus P. G. Van der Steen, Den Dungen (NL)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/633,922

(22) Filed: Dec. 5, 2006

(51) Int. Cl.
*H01R 13/62* (2006.01)

(52) U.S. Cl. ..... 439/159

(58) Field of Classification Search ..... 439/159, 439/160, 155, 630
See application file for complete search history.

(56) References Cited

U.S. PATENT DOCUMENTS 7,077,671 B2 * 7/2006 Su et al. ..... 439/159
7,128,589 B1 * 10/2006 Hsu ..... 439/159
7,140,894 B2 * 11/2006 Tsai ..... 439/159
7,175,452 B1 * 2/2007 Lin et al. ..... 439/159
7,182,613 B2 * 2/2007 Xu et al. ..... 439/159
7,192,292 B1 * 3/2007 Su ..... 439/159
7,198,497 B1 * 4/2007 Lai et al. ..... 439/159
7,207,814 B2 * 4/2007 Chen et al. ..... 439/159

* cited by examiner

*Primary Examiner*—Khiem Nguyen
(74) *Attorney, Agent, or Firm*—Wei Te Chung

(57) ABSTRACT

A card connector for connecting a card (2) to a printed circuit board comprises a housing (1) comprising a receiving section (10) for accepting a card (2) therein and a retaining section (11) enveloped by a front wall (12) and a sidewall (13), a plurality of terminals (8) received in the receiving section (12), a slider (4) engaging with and guiding the card (2) sliding on the receiving section (10), a spring (6) received in the retaining section (11) with one end engaging with a locating pole (120) of the housing (1) and the other end inserted in a channel (410) of the slider (4), a guiding member (5) with one end received in a locating hole (122) disposed in the front wall (12) and the other end slidable engaging with a guiding slot (401) of the slider (4) for guiding the trace of the slider (4), a cover (3) mounted on the housing (1).

20 Claims, 13 Drawing Sheets

ELECTRICAL CARD CONNECTOR

BACKGROUND OF THE INVENTION

1. Field of the Invention

The present invention relates to an electronic card connector, and particularly relates to an electronic card connector for connecting an electronic card to a printed circuit board.

2. Background of the Invention

Small electronic cards with a large memory are nowadays regularly used with many kinds of portable electrical products, for example, cell phones, digital cameras and PDAs. The electrical product has a PCB and an electrical card connector fixed on the PCB for accommodating an electronic card and electrically connecting it to the conductive terminals of the electronic card. The electrical card connector further includes an ejector for ejecting the electronic card that is accommodated in the electrical card connector. Because the electronic card is frequently inserted and ejected from the electrical card connector, the electrical card connector must be durable enough to ensure the smooth insertion and ejection of the electronic card from the electrical card connector so no damage is caused, thus avoiding the situation where the electrical card connector fails to connect with the electrical card. Hence the conductive terminals of the electrical card connector and the electronic card are electrically connected to each other.

Referring to U.S. Pat. No. 6,729,894 illustrates an appearance of a related card connector. The card connector mainly comprises as an element a base member in which a plurality of contact terminals are arranged at one end thereof in the widthwise direction, for detachably accommodating an IC card; a cover member covering all over the base member to define an accommodating chamber for the IC card; and an ejecting mechanism for selectively holding the IC card to be mounted in the chamber (in a locked state) or discharging the IC card therefrom (in an unlocked state).

However, the ejecting mechanism of the abovementioned connectors do not provide a reliable and stable guiding to the card received in a space formed by the housing and cover. And the connector could not provide a data protection function when the card is rejected suddenly.

With the employment of unique considerations and application of theories, and based on several years experience in specialized production of all flexible assembly systems and mechanisms, the inventor has come up with an innovative electrical card connector.

SUMMARY OF THE INVENTION

An object, therefore, of the invention is to provide a new and improved card connector able to prevent a card received therein flying out.

Another object of the invention is to provide a new and improved card connector able to prevent data stored therein from loosing data with card removal.

In the exemplary embodiment of the invention, In order to achieve the above objectives, the present invention provides an electrical card connector, comprising an insulative housing comprising a receiving section and a retaining section, a plurality conductive terminals attached on the receiving section, a slider having guiding slot received in the retaining section for guiding the card insertion, a spring received in the housing for engaging with slider, and a guiding member with one end received in the housing, the other end engaging with slider for guiding the slider's sliding trace, a detecting terminal received in the housing and a cover defining a cover contact engaging with the detecting terminal to detect whether the card inserted or not. By the engagement or disengagement between the detecting terminal and the cover terminal, a card switch that will switch off the memory system of the electric component before the terminal between terminals and card pads is broken. Using the guiding member guiding the slider sliding in the retaining section, the advantage of this method is that connector can not loose data with card removal. Another feature of the connector have is card fly-out protection. At the moment that the card is suddenly released, the card will not "pop out". The slider provides card fly-out protection and when the card switch has a switch point just before the memory card touches the slider the slider will provide also the time delay function.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
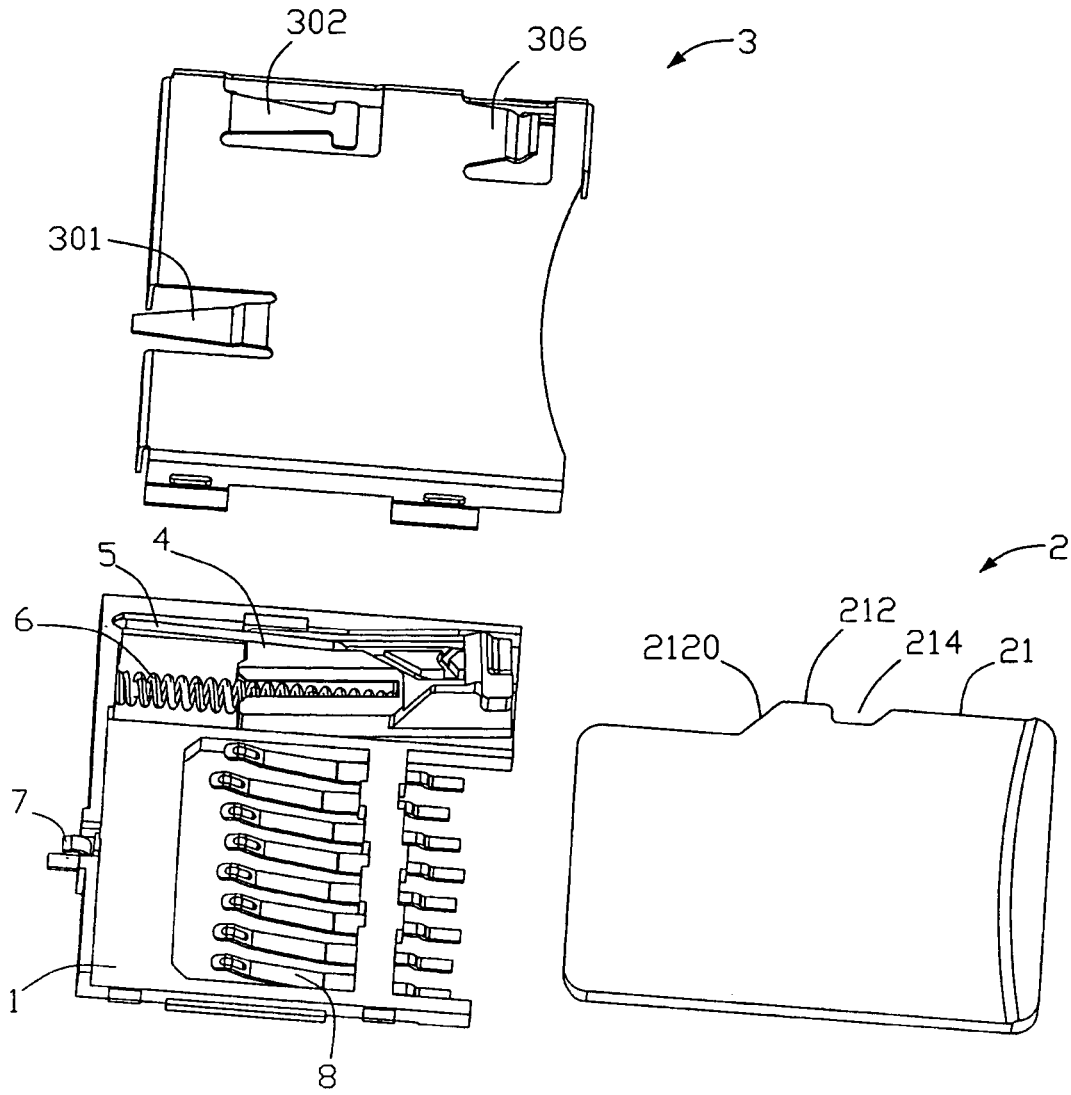
FIG. 1 is an isometric perspective view of the card connector.
Figure 2:
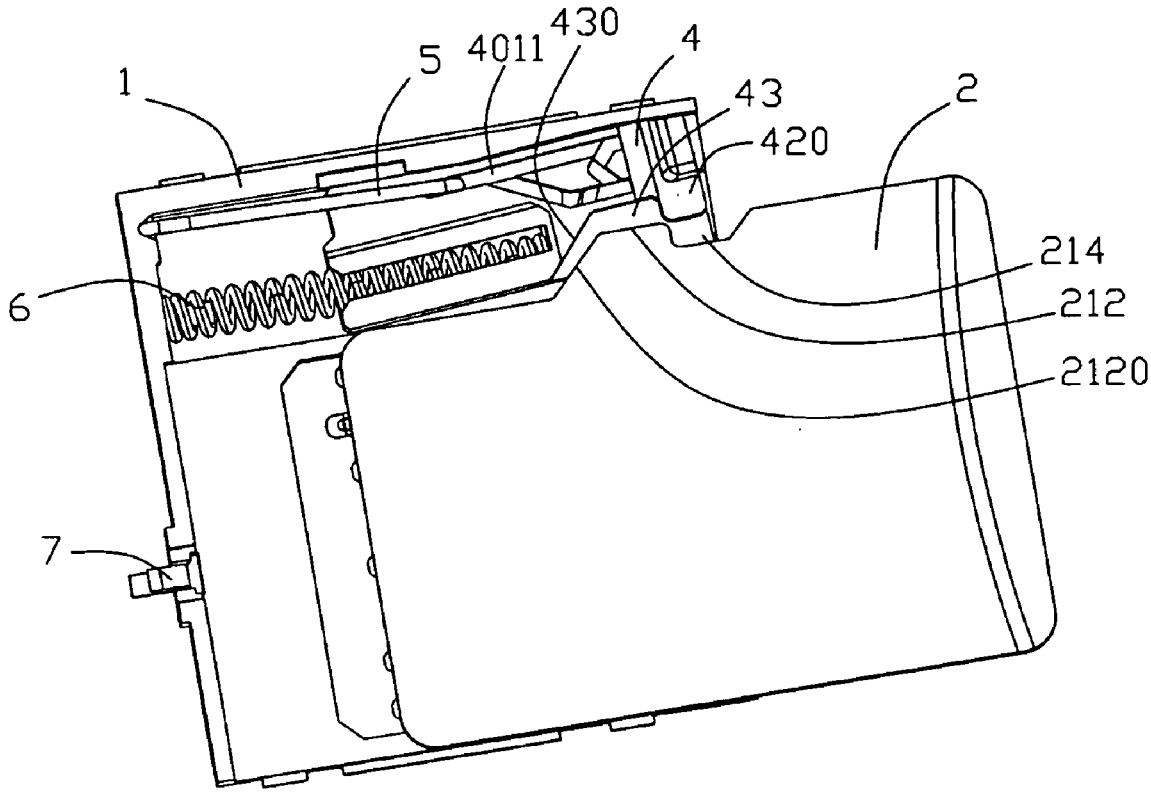
FIG. 2 is an isometric perspective view of the card connector shown in FIG. 1, when the card is initially inserted into the connector, wherein the cover is taken.
Figure 3:
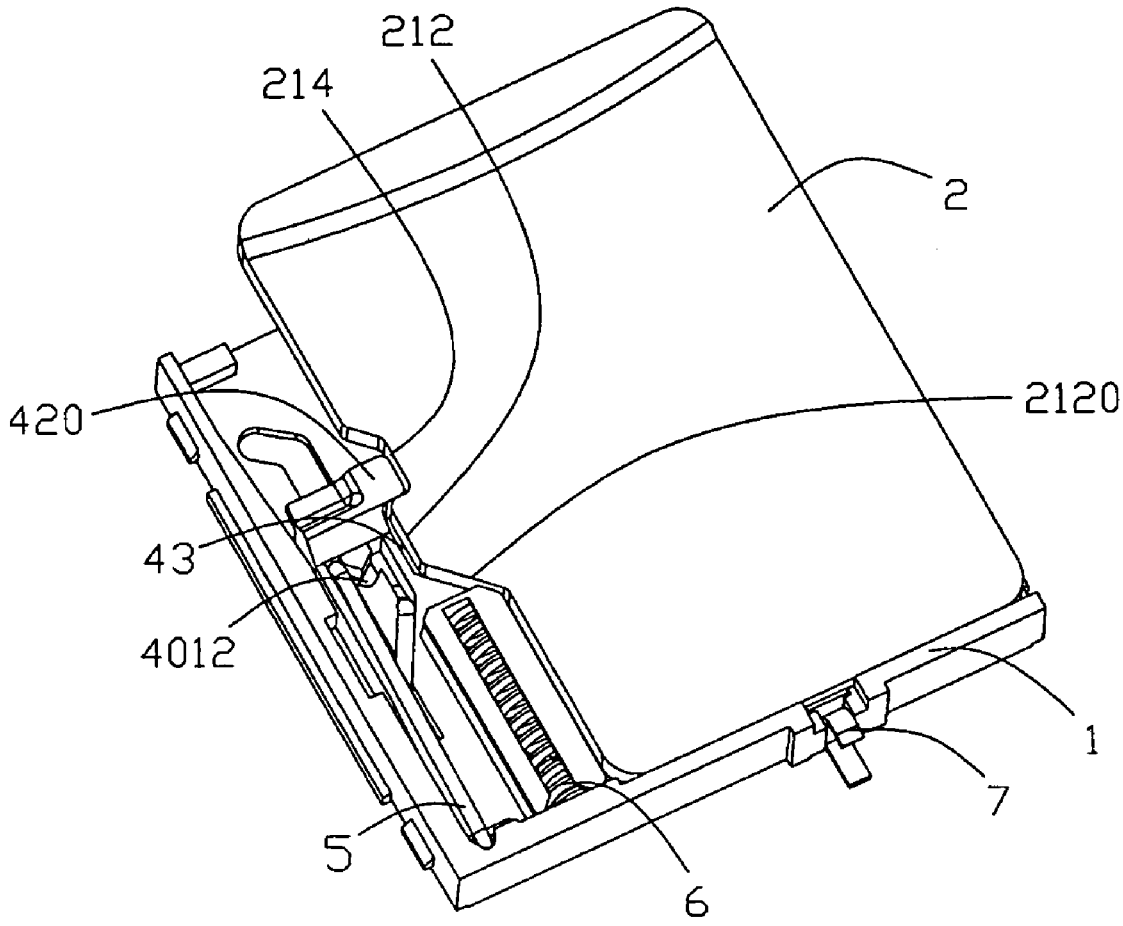
FIG. 3 is another isometric perspective view of the card connector shown in FIG. 2 when the card has been totally inserted into the connector, wherein the cover is taken.
Figure 4:
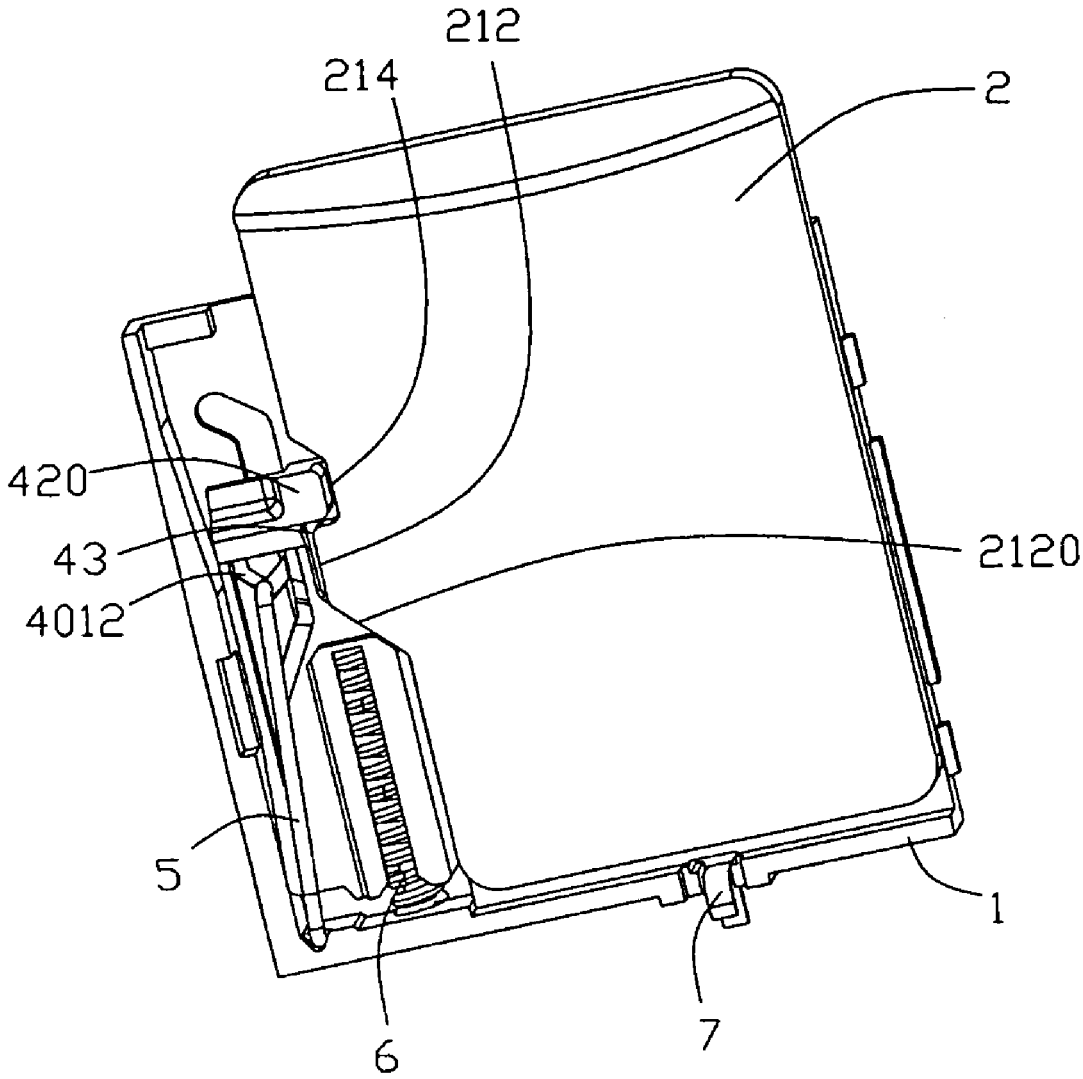
FIG. 4 is an isometric perspective view of the card connector shown in FIG. 1 when the card has been partially pulled out from the connector, wherein the cover is taken.
Figure 15:
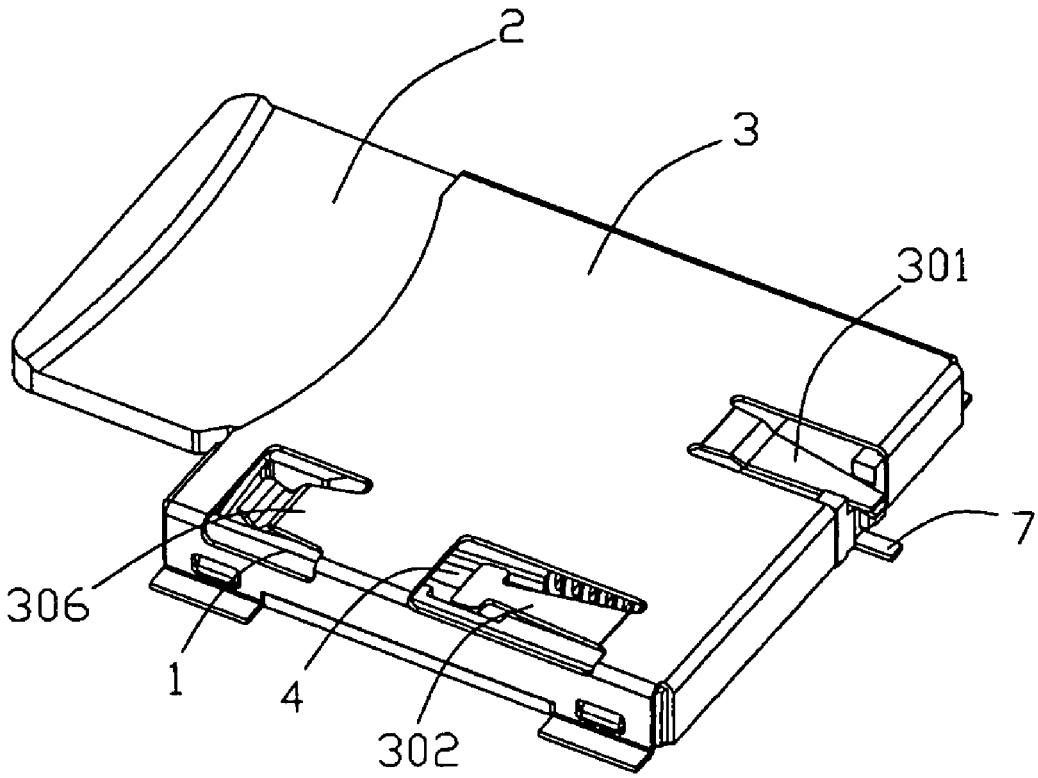
FIG. 15 is an assembled perspective view of the card connector shown in FIG. 1.

Referring to FIGS. 1 and 15, the present invention provides an electrical card connector for connecting an electronic card 2 to a printed circuit board. The electrical card connector includes an insulative housing 1 with a receiving section 10 and retaining section 11, a plurality of conductive terminals 8 received in the receiving the section 10, a slider 4 for guiding the card 2 moveablely supported by the retaining section 10, a spring 6 received in the housing 3 for elastically engaging with slider 4, a guiding member 5 for guiding the slider 4 sliding in the retaining section 3, and a detecting terminal 7 received in the housing 1 and a cover 3 mounted on the housing 1.

The card 2 is made of rectangular shape and comprises an engaging side 21 with a projected portion 212 and an opening 214 for engaging with the slider 4. The projected portion 212 defines a slant surface 2120 for engaging with a corresponding part of the slider 4 to push the card 2 slide in the retaining section 11.

The insulative housing 1 comprises a front wall 12, a sidewall 13, and a body portion enveloped by the front wall 12 and the sidewall 13 including a receptacle section 10 and a retaining portion 11. The receiving section 10 defining a terminal section for receiving the terminals 8 therein, the retaining portion 11 for supporting the slider 4 thereon. The front wall 12 further extends a locating pin 120 for engaging one end of the spring 6 thereon and defines a recess 124 for receiving the detecting terminal 7 therein, and a platform 122 indented a portion adjacent to a corner thereof defining a locating hole 1220 for receiving one end of the guiding member 5 therein. The retaining section 11 defines a cavity with a bottom surface 111 for receiving the slider 4 thereon. The bottom surface 111 defines a channel 110 with a first channel 1101 and a second channel 1102 angled with the first channel 1101 for guiding the slider 4 sliding in the cavity. The recess 124 further defines an inner recess 1241 and an outer recess 1242. The outer recess 1242 defines an upper recess 1243, a lower recess 1245 and a center recess 1244. The sidewall 13 defines a straight section 131, a slant section 132 extending from the straight section 131 and an end section 133 connecting with the slant section 132, the slant section 132 can lead the slider 4 sliding in the retaining section along a predetermined trace. The retaining section 11 further defines a protrusion 112 adjacent to the end section 131 for engaging with the slider 4 and an opening 116 adjacent to the protrusion 112.

The slider 4 includes a main portion 40, a supporting portion 41 extending upwardly from an end of the main portion 40, a projected portion 42 extending from an opposite end of the main portion 40 and a recessed portion 43 figured into a shape for coupling with the protruding portion 212 of the card 2 sandwiched by the projected portion 42 and the supporting main portion 41 for engaging with and leading the card 2 sliding on the housing 1. The supporting portion 41 defines a channel 410 for partially receiving the spring 6 therein. The projected portion 42 defines an engaging portion 420 for engaging with the opening 214 of the card 2, when the card 2 is inserted into the housing 1. The recessed portion 43 defines a slant side 430 for engaging with projected portion 212 of the card 2. The main portion 40 defines a guiding slot 401 for guiding the guiding member's 5 sliding trace to lead the card 2 engaging with the slider 4 sliding along a predetermined orbit. The guiding slot 401 comprises a smoothly first slot 4011, a smoothly second slot 4012 bended and connecting with and the first slot 4011 and a smoothly third slot 4013 connecting with the first and second slot 4011, 4012. The second slot 4012 is configured into a V-shaped trace for providing a time delay function. The first slot 4011, the second slot 4012 and the third slot 4013 connect with each other and form a circulating channel for guiding the trace of the guiding member 5. The depths of the first slot 4011, the second slot 4012 and the third slot 4013 are disposed in a decreasing dimension in turn for facilitating the guiding member 5 roundly sliding therein. When the card 2 is inserted in the receiving space formed by the cover 3 and the housing 1, the guiding member 5 slides from an initial position in the first slot 4011 where the spring 6 lies in an original state. When the guiding member 5 stands in a higher position of the first slot 4011, the card 2 is totally inserted into the receiving space. When the card 2 is pulled out, the guiding member 5 firstly slides into the V-shaped second slot 4012 and then turns into the third slot 4013. When the card 2 is totally pulled out, the guiding portion 51 of the guiding member 5 turns back to the initial position. During the guiding portion 5 slides in the guiding slot 401, the design of the V-shaped configuration of the second slot 4012 and the third slot 4013 can provide the time delay effect, which avoids the card 2 being suddenly released. In addition, the slider further defines a bottom portion 44 comprises a projected member 440 inserted into the channel 100 of the retaining section 10 and a concaved portion 442 for engaging with the protrusion 112

The guiding member 5 is a bended pole-shaped member and comprises a connecting portion 50 and a fixing portion 52 and a guiding portion 51 angled, from two opposite end of the connecting portion 50, wherein the fixing portion 52 is inserted into the locating hole 1220 of the front wall 12 of the housing 1, the guiding portion 51 is inserted into the guiding slot 401 of the slider 4 for guiding the slider 4 sliding thereon.

A spring 6 received in the channel 410 of the slider 4 for providing an elastic power to actuate the slider 4 sliding on the retaining section 11 between the initial position and the second position, wherein the initial position is the slider located on a position where the spring 6 stands an initial state and the second position is the slider located on a position where the spring 6 is pressed into a shortest form, during the card 2 moving in the housing 1.

The cover 3 is covered on the insulative housing 1, and engages with housing 1 for cooperatively forming a receiving space to receive the card 2 therein. The cover comprises a planar base portion 30, a rear wall 32 and two opposite sidewall 31 extending from the base portion 30 cooperatively forming a receiving space for receiving the housing 1 therein, and an elongated channel for facilitating the card 2 being inserted. The cover 3 further defines a first window 304 and a second window 308 adjacent to a portion of the base portion 30 covered on the slider 4 and a first elastic pad 302 integrately punched from the first window 302 and a second elastic pad 306 integrately punched from the second window 306 adjacent to the sidewall 31 for elastic abutting against the slider 4 received in the housing 1, a cover contact 301 punched from a side of an opening 300 communicating with the rear wall 32 and the base portion 30 for contacting with the detecting terminal 7. The first elastic pad 302 comprises an extending pad 3020 connecting with cover 3 and a contacting pad 3022 extending from the extending pad 3020 for contacting with the slider 4. The second pad comprises 306 a main pad 3060 connecting with the cover 3 and an arched elastic pad 3062 connecting with the main pad 3060 for abutting against the slider 4 mounted thereunder. The contacting pad and the arched elastic pad abut against an upper surface of the slider, when the card is pulled out, which can decrease the speed of the card, hence providing a delay-protect function. The cover contact 301 comprises a base portion 3010 extending from the cover 301, a bended portion 3012 extending slantly and downwardly from the base portion 3010 and a resilient portion 3014 for elastic contacting with the detecting contact 7. In addition, the cover further defines a number of fixing pads 310 vertically extending from the sidewall 31 for connecting with the printed circuit board.

The electrical card connector further includes a detecting terminal 7 arranged on the front wall 12 of the insulative housing 1 for detecting whether the electronic card 2 is totally inserted into the receiving space or not. That is when the card 2 is totally inserted into the housing 1, the detecting terminal 7 is disengaged with the cover contact 12 separated by the card. When the card 2 is pushed outside, the engagement between the detecting terminal 9 and the cover terminal 11 is connected, hence the card assembly can switch off the memory system of the outer appliance before the connection between the terminals 8 received in the housing 3 and the card 2 is broken. The detecting contact 7 is arranged on the rear wall 12 of the insulative housing 1. The detecting contact 7 has a triangle-shaped inserting portion 71 inserted into the inner recess 1401, an engaging tail 72 extending from one end of the inserting portion 71 and received in the upper recess 1403 for engaging with the cover contact 301 and a solder tail 73 extending from the other end of the inserting portion 71 and received in the lower recess 1405 for being soldered to the printed circuit board.

The conductive terminal 8 is arranged on receiving section 10 of the housing 1 and comprises a main section 81, a contacting section 82 extending from one end of the main section 81, and a tail section 83 extending from the other end of the main section 81.

In assembly, the slider 4 firstly is inserted into the retaining section 11 of the housing 1 with the projected member being inserted into the channel 110, and one end of the spring 6 is mounted in the receiving slot 410 of the slider 4 and the other end is engaging with the locating pin 120 of the housing 1, then the guiding member 5 is mounted in the retaining section 11 too with the fixing portion 52 received in the locating hole 1220 of the housing 1 and the guiding portion 51 received in the guiding slot 401 of the slider 4. Continued, the terminals 8 are inserted into the terminal section of the housing 1 and the detecting terminal 7 is inserted into the receiving recess 124 of the rear wall 12. At last, the cover 3 is covered on the housing 1. In this time, the detecting contact 7 is abutting against the cover contact 301 with the engaging tail 72 contacting with the resilient portion 3014 of the cover contact 301. And then the card 2 is inserted into the receiving space cooperatively formed between the cover 1 and the housing 3. When the card 2 is totally inserted into receiving space, the detecting contact 7 is disengaged with the cover contact 301.

When the electronic card 2 is inserted into the receiving space cooperatively formed by the housing 1 and the cover 3, the protruded portion 212 of the engaging side 21 is initially engaging with the recessed portion 43 of the slider 4 with the projected portion 420 coupled with concave 214 of the card 2 and the slant surface 2120 engaging with the engaging surface 430 of the recessed portion 43. At this moment, the spring 6 stands in a natural state and the guiding member 5 locates in the initial position. Then, when the card 2 is further pushed, the slider 4 is actuated by the engaging side 21 of the card 2 to move towards the front wall 12; the spring 6 is pressed in the slider's sliding direction and the guiding member 5 is sliding along the first slot 4011 from the initial position. When the card 2 is totally inserted into the receiving space formed by the housing 1 and the cover 3, the guiding member 5 is located in a higher position in the first slot 4011 that is near to the second slot 4012.

Figure 5:
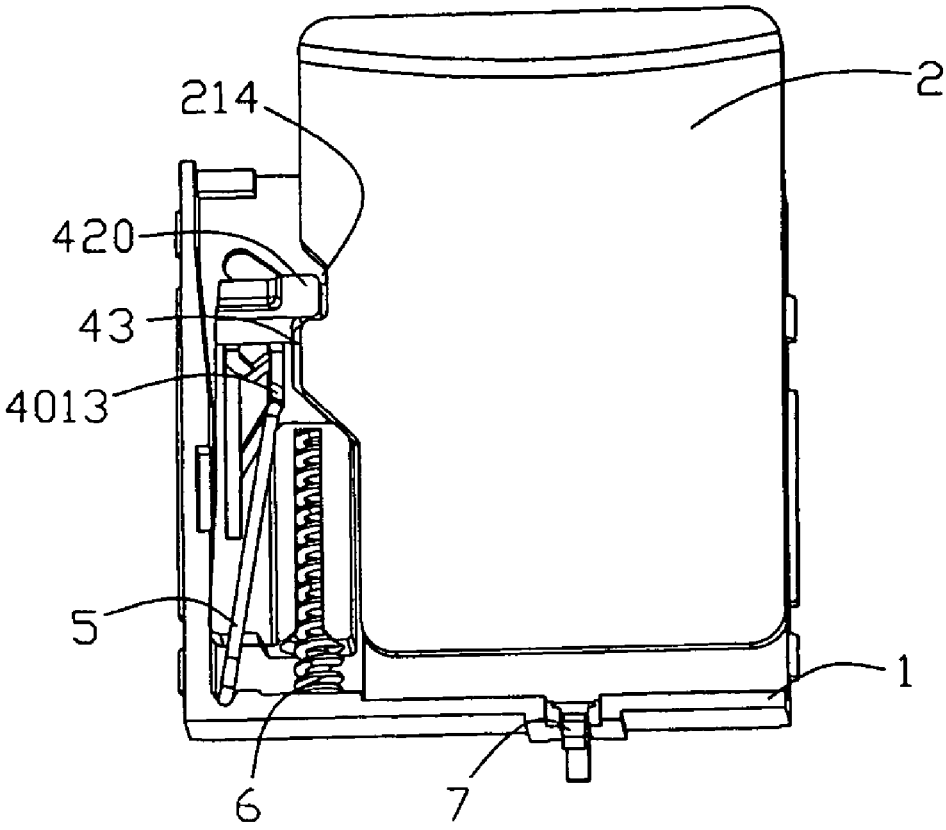
FIG. 5 is another isometric perspective view of the card connector shown in FIG. 1 when the card has been partially pulled out from the connector, wherein the cover is taken.
Figure 6:
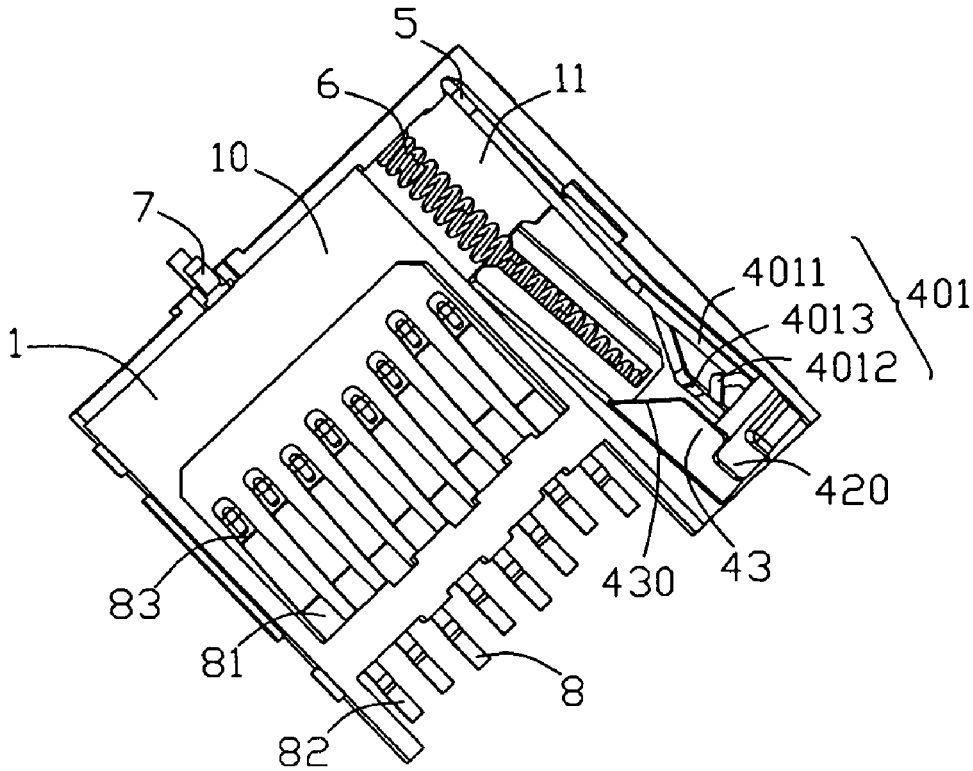
FIG. 6 is an isometric perspective view of the card connector shown in FIG. 1 when the card and the cover are taken.
Figure 7:
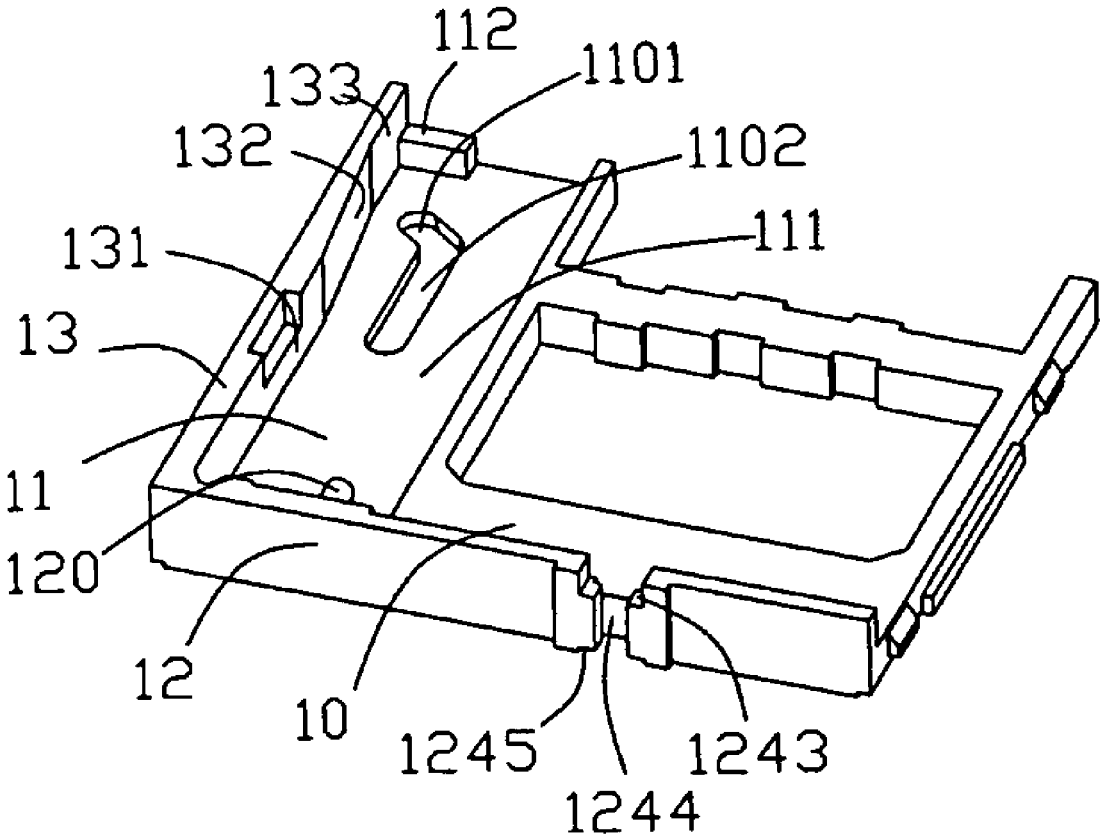
FIG. 7 is an isometric perspective view of the housing in the card connector shown in FIG. 1.
Figure 8:
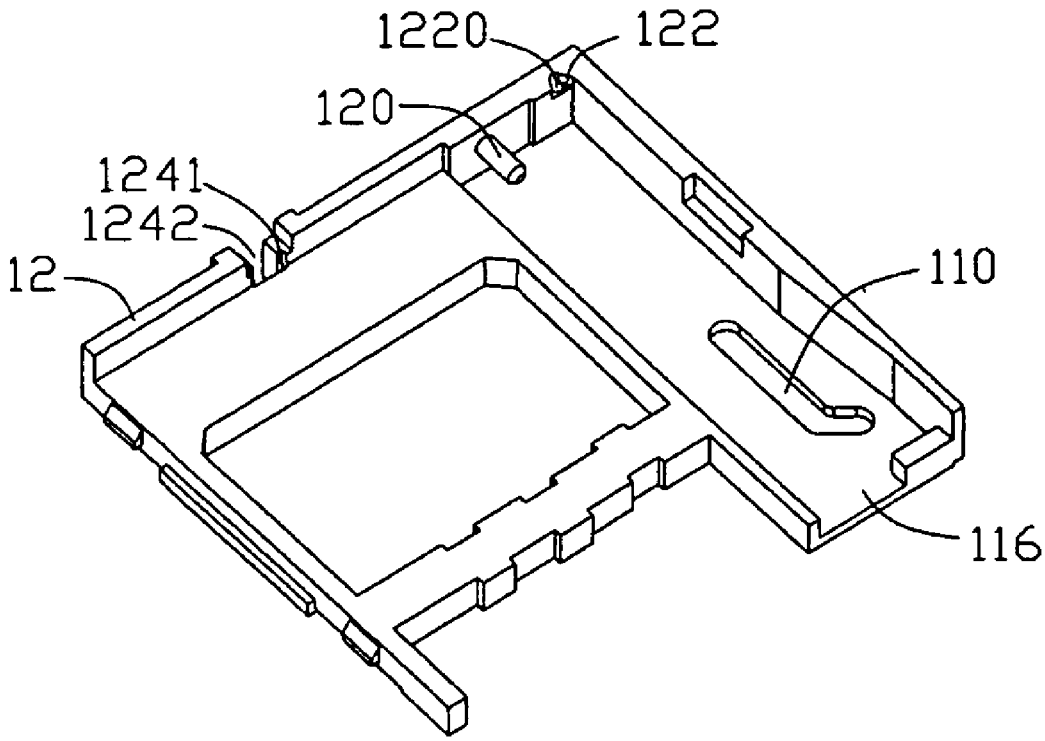
FIG. 8 is another isometric perspective view of the housing of the card connector shown in FIG. 1.
Figure 9:
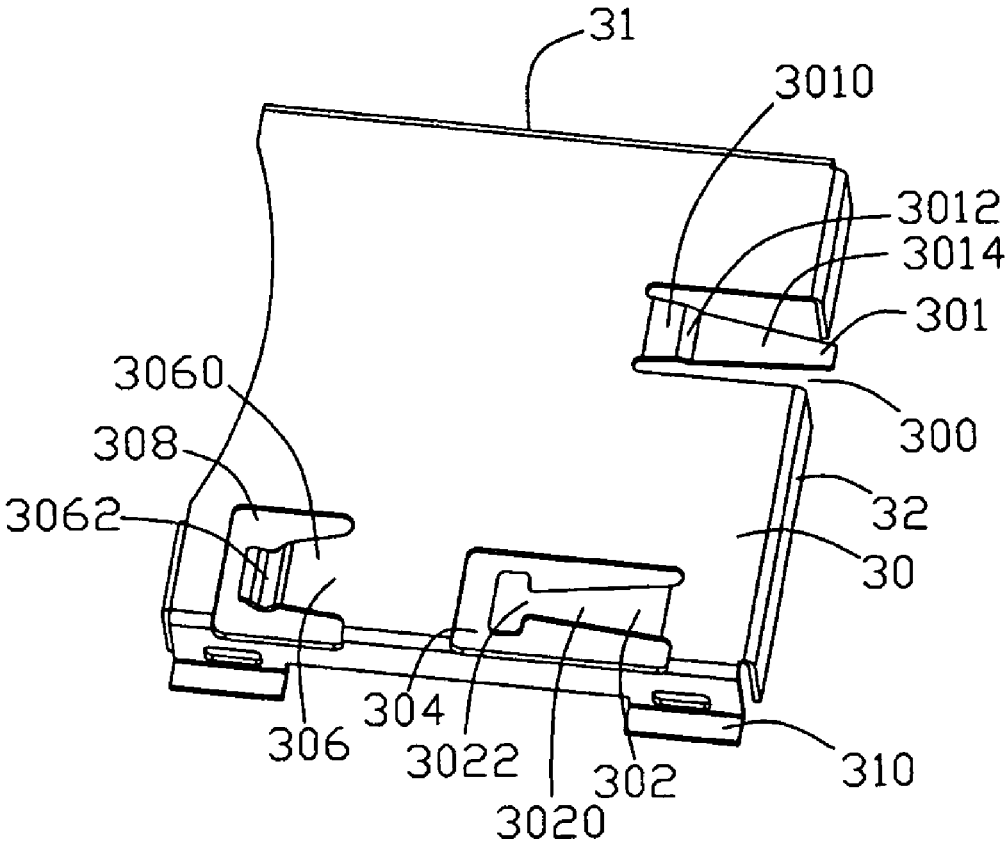
FIG. 9 is an isometric perspective view of the cover of the card connector shown in FIG. 1.
Figure 10:
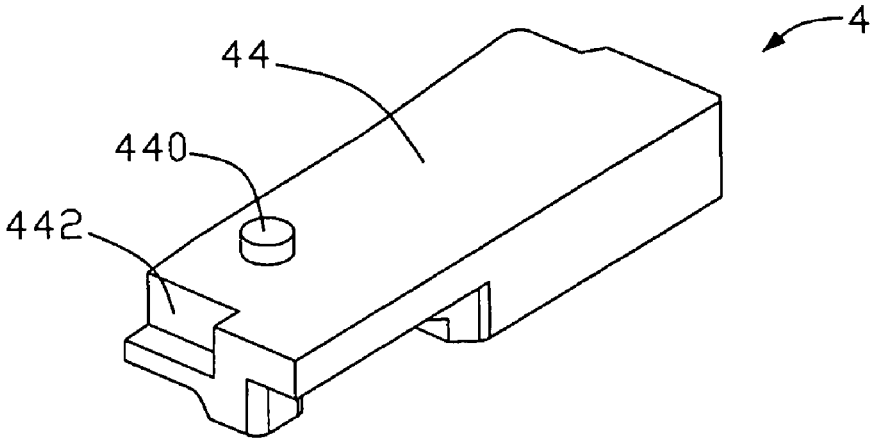
FIG. 10 is a bottom view of the slider of the card connector shown in FIG. 1.
Figure 11:
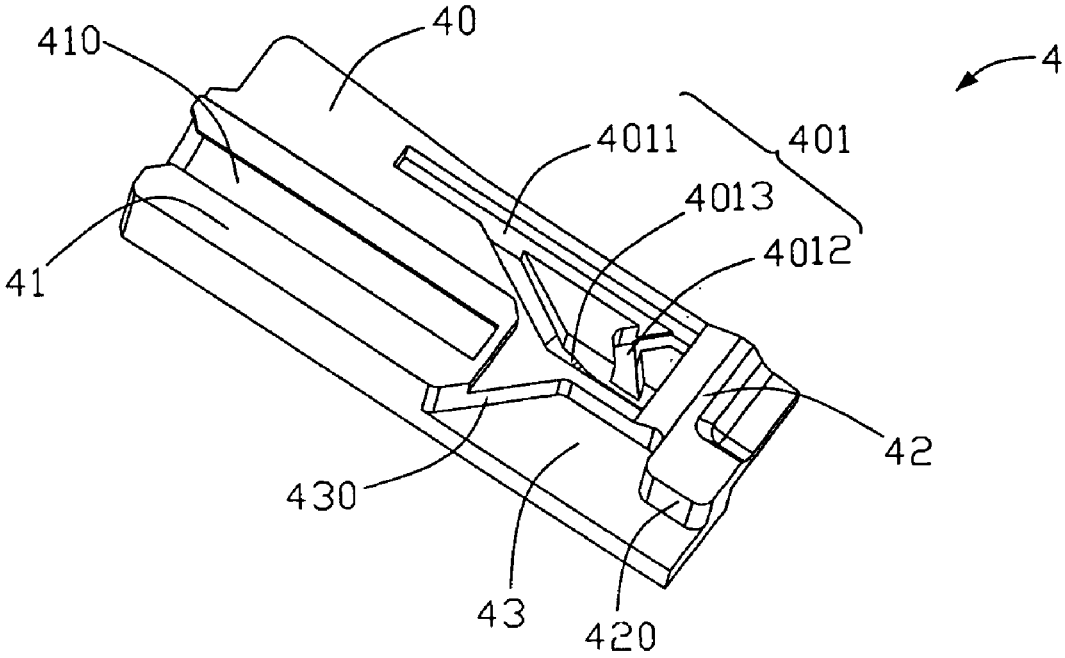
FIG. 11 is an isometric view of the slider of the card connector shown in FIG. 1.
Figure 12:
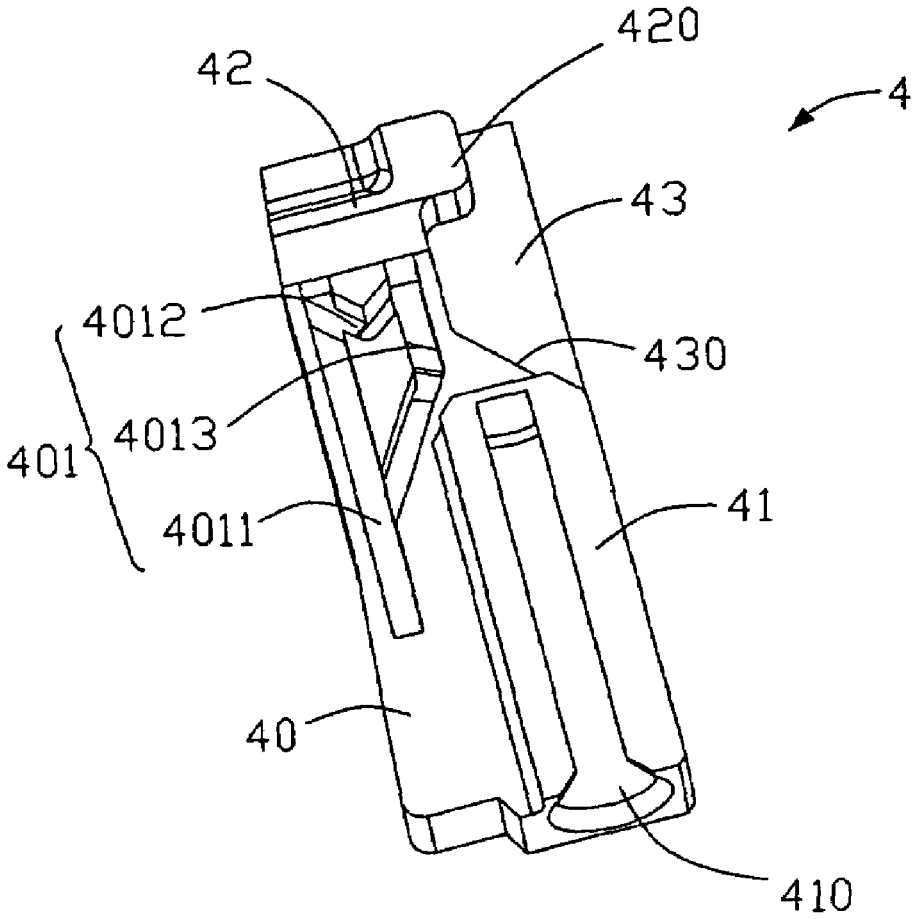
FIG. 12 is another isometric view of the slider of the card connector shown in FIG. 1.
Figure 13:
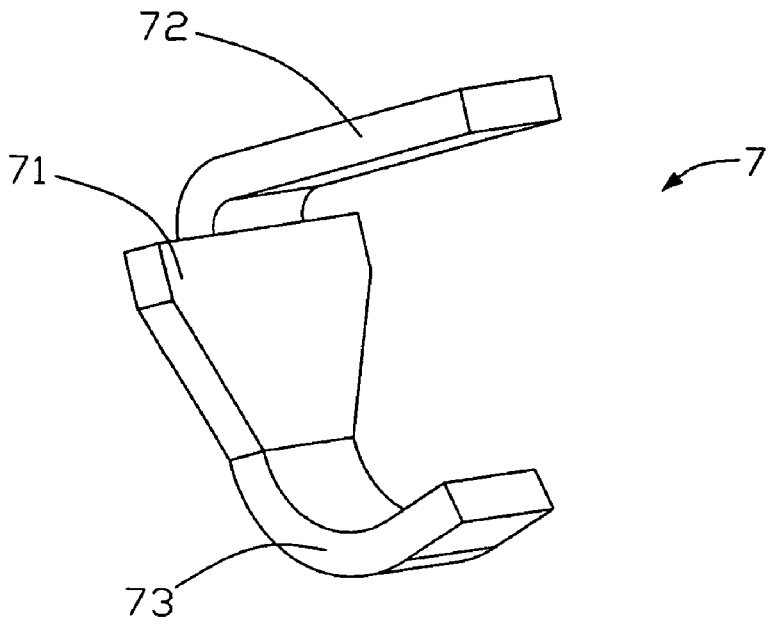
FIG. 13 is an isometric perspective view of the detecting terminal of the card connector shown in FIG. 1.
Figure 14:
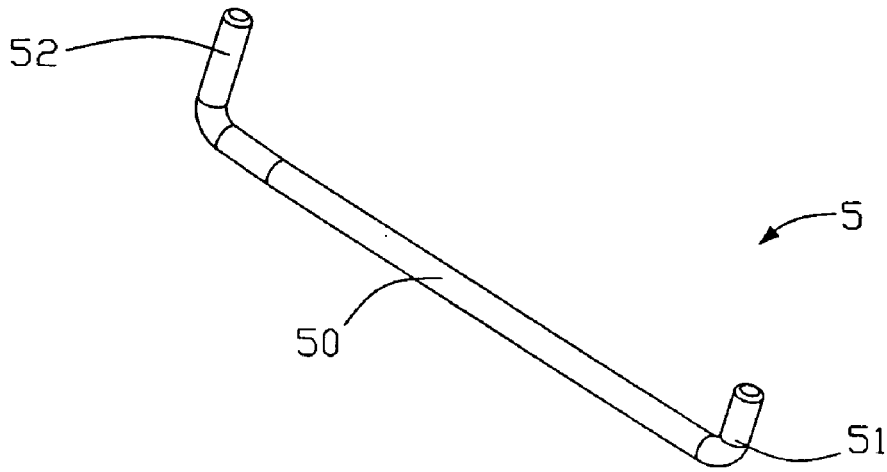
FIG. 14 is an isometric perspective view of the guiding member of the card connector shown in FIG. 1.

Referring to FIG. 5, When the card 2 is pulled outside, the slider 4 slides with card 2 and the spring 7 restore with moving in company with the slider 4. The guiding position 51 of the guiding member 5 slides around the guiding slot 401. Due to the engaging portion 420 of the slider 4 engaging with the opening 214, and the arched elastic pad 306 abutting against the projected portion 42 of the slider, when the card slides out the receiving space, which decreases the card rejecting movement's speed and moderates the spring's momentum. So the card 2 is prevented from flying out from the connector. The engagement between the engaging portion 420 and the opening 214, and the engagement between the elastic pad 3062 and the slider 4 delay the card ejecting speed and prevent the card 2 flying out quickly. In addition, with the card 2 being pulled outwardly, the detecting contact 7 is separated with the cover contact 301, which provide a signal that the card 2 is pulled outwardly, So there is enough time to switch off the memory system of the mobile appliance before the connection of the terminals 8 with the card 2 is broken.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. A card connector for connecting a card to a printed circuit board comprising:

a housing comprising a receiving section for accepting a card therein and a retaining section;

a plurality of terminals received in the receiving section;

a slider received in the retaining section having a projected portion for engaging with an opening of the card;

a spring received in the retaining section with one end abutting the housing and the other end inserted in a channel of the slider;

a guiding member with one end received in the housing and the other end slidable engaging with a guiding slot of the slider for guiding the trace of the slider;

a cover mounted on the housing comprising at least one elastic pad for abutting against the projected portion of the slider.

2. The card connector as claimed in claim 1, further comprising a detecting contact, and the cover further defines a cover contact for engaging with the detecting contact.

3. The card connector as claimed in claim 1, the slider comprises a main portion, a supporting portion extending upwardly from an end of the main portion, a projected portion extending from an opposite end of the main portion and a recessed portion figured into a shape for coupling with a protruding portion of the card sandwiched by the projected portion and the supporting main portion for engaging with and leading the card sliding on the housing.

4. The card connector as claimed in claim 1, wherein the slot comprises a first slot, a second slot bended and connecting with and the first slot and a smoothly third slot connecting with the first and second slot.

5. The card connector as claimed in claim 4, wherein the depths of the first slot, the second slot and the third slot are disposed in a decreasing dimension in turn for facilitating the guiding member sliding therearound.

6. The card connector as claimed in claim 1, wherein the guiding member is a bended pole-shaped member and comprises a connecting portion and a fixing portion and a guiding portion angled from two opposite end of the connecting portion, wherein the fixing portion is inserted into a locating hole of the front wall of the housing, the guiding portion is inserted into a guiding slot of the slider for guiding the slider sliding thereon.

7. The card connector as claimed in claim 1, wherein the cover defines a window adjacent to a portion of the cover covered on the slider and the elastic pad integrately punched from the window for elastic abutting against the slider received in the housing.

8. The card connector as claimed in claim 7, wherein the elastic pad comprises an extending pad connecting with cover and a contacting pad extending from the extending pad for contacting with the slider.

9. The card connector as claimed in claim 1, wherein the detecting contact comprises an inserting portion, an engaging tail extending from one end of the inserting portion for engaging with the cover contact and a solder tail extending from the other end of the inserting portion for being soldered to the printed circuit board.

10. The card connector as claimed in claim 1, wherein the recess comprises an inner recess for receiving the engaging tail and an outer recess for receiving the solder tail therein.

11. The card connector as claimed in claim 1, wherein the retaining section defines a channel with a first channel and a second channel angled with the first channel for guiding the slider sliding thereon.

12. The card connector as claimed in claim 11, wherein the slider further defines a projected member on a bottom portion thereof to be inserted into the channel of the retaining section.

13. The card connector as claimed in claim 2, wherein the cover contact comprises a base portion extending from the cover, a bended portion extending slantly and downwardly from the base portion and a resilient portion for elastic contacting with the detecting contact.

14. The card connector as claimed in claim 1, wherein the sidewall defines a straight section, a slant section extending from the straight section and an end section connecting with the slant section, the slant section engages one side of the slider for guiding the slider sliding in retaining section along a predetermined trace.

15. A card connector for connecting a card to a printed circuit board comprising:

a housing comprising a receiving section for accepting a card therein and a retaining section;

a plurality of terminals disposed in the receiving section;

a slider received in the retaining section having a projected locking portion for engaging with an opening of the inserted card; and a spring urging the slider to move; wherein the slider moves not only in a lengthwise direction, along which the card is inserted into the housing or ejected from the housing, but also a transverse direction perpendicular to said lengthwise direction so as to move said locking portion toward for locking the card or away from the opening of the inserted card for unlocking the card.

16. The card connector as claimed in claim 15, wherein movement of the slider along the transverse direction results from a tapered structure on at least one of the slider and the housing.

17. The card connector as claimed in claim 15, wherein a guiding member engages both the slider and the housing to decide the position of the slider relative to the housing along the lengthwise direction.

18. The card connector as claimed in claim 17, wherein the slider defines an engagement section adapted to be engaged with the inserted card.

19. The card connector as claimed in claim 15, wherein a metallic shell is attached to the housing, and movement of the slider along the transverse direction results from a tapered structure on one of the shell and the housing.

20. The card connector as claimed in claim 15, wherein a metallic shell is attached to the housing, and a guiding member engages one of said housing and said shell;

a guiding member with one end received in the housing and the other end slidable engaging with a guiding slot of the slider for guiding the trace of the slider;

a cover mounted on the housing comprising at least one elastic pad for abutting against the projected portion of the slider.

* * * * *